US005713807A

United States Patent [19]

Montaldi

[11] Patent Number: 5,713,807

[45] Date of Patent: Feb. 3, 1998

[54] TABLE TENNIS NET MOUNT

[76] Inventor: David H. Montaldi, 1051 Clubland Ct., Marietta, Ga. 30068

[21] Appl. No.: 802,920

[22] Filed: Feb. 20, 1997

[51] Int. Cl.[6] ..... A63B 61/00

[52] U.S. Cl. ..... 473/491

[58] Field of Search ..... 473/491, 492, 473/493, 494, 116, 118

[56] References Cited

U.S. PATENT DOCUMENTS

| | | | |
|---|---|---|---|
| 2,004,397 | 6/1935 | Sloan . | |
| 2,128,948 | 9/1938 | Kleinman . | |
| 2,769,636 | 11/1956 | Finestone . | |
| 3,754,760 | 8/1973 | Nielsen . | |
| 3,773,323 | 11/1973 | Mirand . | |
| 3,936,049 | 2/1976 | Neumann | 473/491 |
| 4,735,405 | 4/1988 | Marocco . | |
| 4,850,590 | 7/1989 | Lin . | |
| 4,886,269 | 12/1989 | Marocco . | |

FOREIGN PATENT DOCUMENTS

| | | | |
|---|---|---|---|
| 2 224 299 | 12/1973 | Germany . | |
| 1395538 | 5/1988 | U.S.S.R. | 473/118 |
| 1440511 | 11/1988 | U.S.S.R. | 473/116 |
| 661714 | 11/1951 | United Kingdom . | |

*Primary Examiner*—Raleigh W. Chiu

*Attorney, Agent, or Firm*—Cushman Darby & Cushman Intellectual Property Group of Pillsbury Madison & Sutro, LLP

[57] ABSTRACT

An net mounting assembly is provided for mounting a net onto a table or similar flat platform. The assembly comprises a mounting base constructed and arranged to be slipped over an edge of the table. The assembly also includes a first support member disposed on the mounting base and a second support member having an upper portion and a lower portion pivotally disposed on the first support member such that when the net mounting assembly is disposed on the table, the upper portion is disposed above a plane of the table and the lower portion is disposed below the plane of the table. The upper portion is connectable to the net and the lower portion is connectable to a biasing member such that the lower portion pivots inwardly towards the table and the upper portion pivots outwardly away from the table thereby tensioning the net and keeping the net substantially perpendicular to the table.

20 Claims, 4 Drawing Sheets

TABLE TENNIS NET MOUNT

BACKGROUND OF THE INVENTION

1. Field of the Invention

The present invention relates to a mount for a table tennis net, and more particularly, to a mount which securely and stably supports a table tennis net perpendicular to a table without requiring clamps.

2. Description of the Related Art

As is well known, table tennis nets are typically supported on a table by a pair of mounting members extending upwardly and perpendicularly from the edge of the table surface such that a net, when secured at each end to the mounting members, can be positioned across the table. Such mounting members are removably secured to the table by screw clamps or similar mechanisms that engage the bottom surface of the table along the table edge.

A number of problems, however, are associated with these known table tennis net mounts. In order to secure the net mount to the table, the screw clamps must be sufficiently tightened to the table to prevent shifting of the mount relative to the table. Unfortunately, the tightening of the clamp against the table tends to damage both the top and bottom surface of the table. Moreover, as the damage to the table surface progressively worsens by repeated clamping of the table tennis net mount to the table, the mount becomes less likely to keep the net perpendicular to the table because of the irregular and damaged surface upon which the mount must be secured.

These known table tennis mounts also tend to allow the nets mounted thereto to slacken and/or shift out of proper playing position during play. The impact of the table tennis ball against a net during play and the associated forces transmitted by the net to the mounts tend to loosen the screw clamps. Of course, once the clamps loosen, the net attached to the mounts can shift out of proper playing position. To return the net back to a perpendicular position, play must be interrupted, and the clamps must be re-tightened.

SUMMARY OF THE INVENTION

In view of the problems associated with these known table tennis net mounts, it is an object of the present invention to provide a mount for a table tennis net that solves the aforementioned problems by securely and stably supporting a table tennis net perpendicular to a table without screw clamps.

In accordance with the principles of the present invention, this objective is achieved by providing a net mounting apparatus for mounting a net onto a playing surface having longitudinal side edges of determined thickness without the need for screw clamps or similar mechanisms.

In accordance with one embodiment, the net mounting apparatus of the invention includes a pair of net mounting assemblies. Each net mounting assembly comprises a mounting base constructed and arranged to be slipped over the longitudinal side edge of the playing surface and a first support member coupled to the mounting base. Each net mounting assembly also includes a second support member having an upper portion and a lower portion. The second support member is pivotally coupled to the first support member such that when the net mounting assembly is disposed on the playing surface, the upper portion of the second support member is disposed above a plane of the playing surface and the lower portion of the second support member is disposed below the plane of the playing surface.

The upper portion of the second support member is adapted to be connected to an end of a net, and the lower portion of the second support member is adapted to be operatively coupled to a biasing member.

When each net mounting assembly is disposed on opposite longitudinal side edges of the playing surface and when the upper portion and the lower portion of each of the second support members are operatively coupled to the net and biasing member, respectively, each lower portion pivots inwardly towards the other and each upper portion pivots outwardly away from the other thereby tensioning the net and keeping the net substantially perpendicular to the playing surface.

In accordance with another embodiment, the net mounting assembly of the invention is configured to function independently of any other net mounting assembly that may be used to support a net. The net mounting assembly includes a mounting base constructed and arranged to be able to be slipped over an edge of a table tennis surface. The net mounting assembly also includes a first support member disposed on the mounting base and a second support member pivotally disposed on the first support member. The second support member has a portion adapted to be connected to an end of the net and is constructed and arranged to pivot in response to a force acting below a plane of the table such that the net is tensioned and maintained substantially perpendicular to the table.

These and other objects of the present invention will become apparent from the following detailed description, taken in conjunction with the accompanying drawings, which illustrate, by way of example, an embodiment of the principles of the present invention.

DESCRIPTION OF THE PREFERRED EMBODIMENTS

Figure 1:
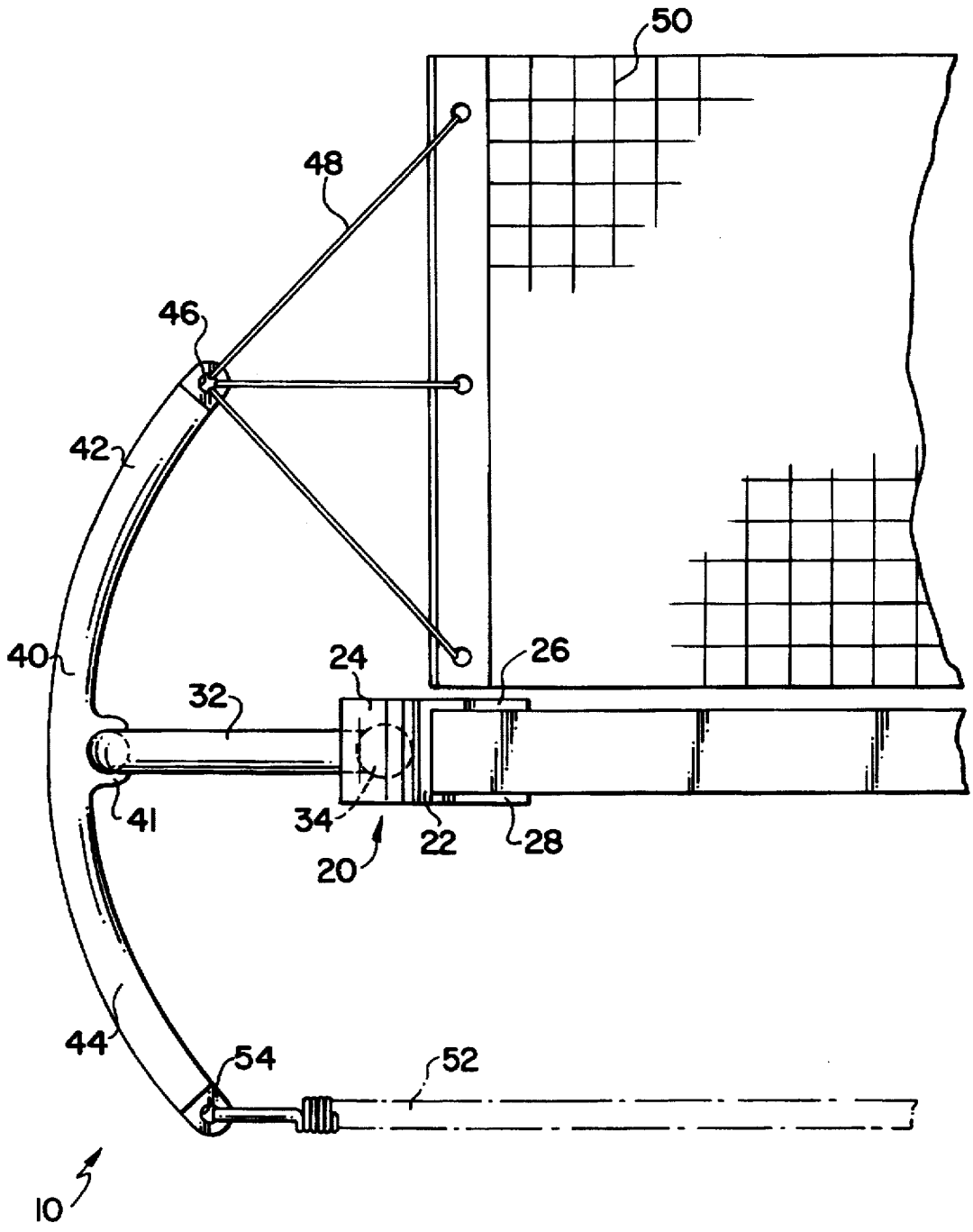
FIG. 1 is an elevational view of a first embodiment of the net mount assembly in accordance with the present invention showing a connection of the net mount assembly to a table tennis net and a biasing member.
Figure 2:
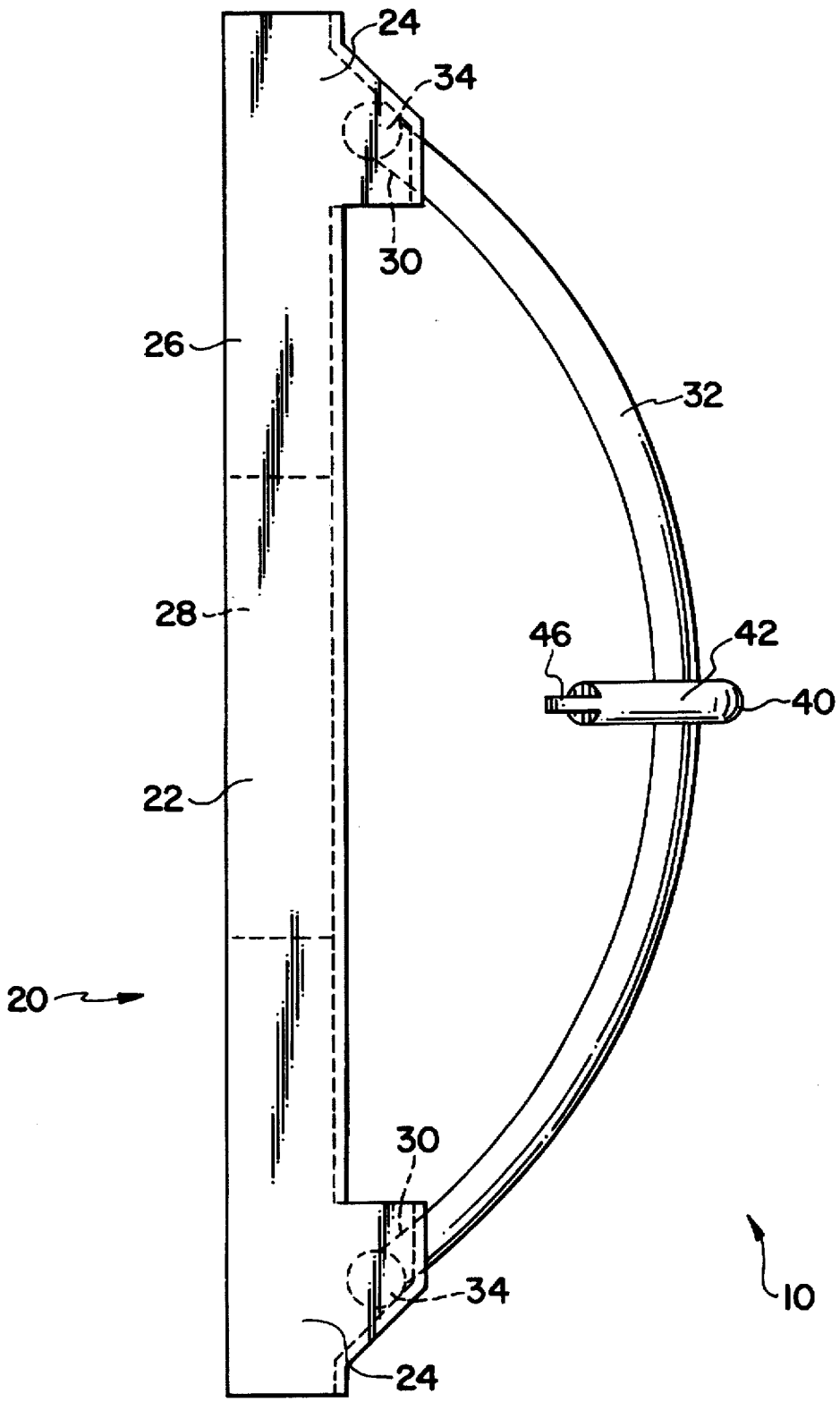
FIG. 2 is a plan view of the net mount assembly in accordance with the first embodiment of the present invention.
Figure 3:
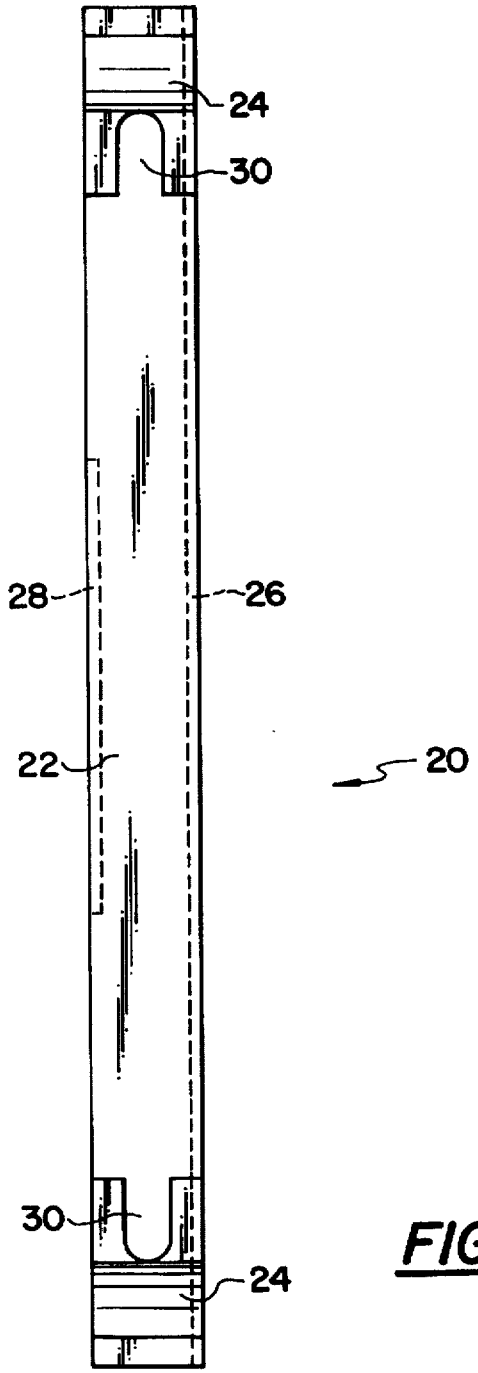
FIG. 3 is an elevational view of a mounting base in accordance with the first embodiment of the present invention.

As best shown in FIGS. 1–3, the net mounting assembly 10 of the present invention includes a mounting base 20. The mounting base 20 provides the foundation upon which the remaining components of the present invention are disposed and is configured to be slipped over an edge of a playing surface, table or similar flat platform and to be stably maintained on the table without requiring a clamp. More particularly, in the illustrated embodiment, the mounting base 20 includes a central portion 22 having a U-shape, transverse cross-section and connection portions 24 laterally spaced on each side of the central portion 22.

As best shown in FIG. 3, the central portion 22 includes an upper flange 26 that preferably extends the entire length of the mounting base 20. In the broadest concept of the invention, however, the upper flange 26 need only be long enough to allow the mounting base 20 to be stably and securely mounted to a table. The upper flange 26 should also have sufficient width so that the mounting base 20 remains on the edge of a table when placed thereon. The length of the upper flange 26 is preferably between 4 and 15 inches, more preferably between 8 and 12 inches, and most preferably 12 inches. The width of the upper flange 26 is preferably between 0.5 and 3 inches, more preferably between 1 and 2 inches, and most preferably 1 inch.

The central portion 22 also includes a lower flange 28 spaced from the upper flange 26 thereby defining a channel therebetween. The lower flange 28 should be sufficiently spaced from the upper flange 26 so that the central portion 22 can be slipped over an edge of a table. The lower flange 28 need not extend the entire length of the mounting base 20, but should have sufficient length to resist any tendency of the mounting base 20 to pivot off the edge of a table. The length of the lower flange 28 is preferably between 2 and 6 inches, more preferably between 3 and 5 inches, and most preferably 5 inches.

As best shown in FIGS. 2–3, the connection portions 24 are disposed on the ends of the mounting base 20. One skilled in the art will readily recognize that, in the broadest concept of the invention, the connection portions 24 need not be placed at the ends of the mounting base 20, but could be disposed in any spaced relationship along the length of the mounting base 20 that would allow the net mounting apparatus to position a net centrally across the playing surface. Each connection portion 24 also defines a socket 30 into which a first support member 32 is inserted, as described in more detail below.

The mounting base 20 can be constructed from any material providing sufficient rigidity and strength for mounting a table tennis net including plastic, wood or metal. The mounting base 20 is preferably constructed from plastic.

As shown in FIGS. 1 and 2, a first support member 32 is disposed on the mounting base 20. More particularly, the first support member 32 is a resiliently flexible, arcuate member constructed from any suitably resilient and flexible material, preferably plastic. Bulbous portions or balls 34 are provided on each end of the first support member 32, and are preferably integrally formed therewith. The effective length of the first support member 32 (i.e., the span between each ball 34) should be greater than the spacing between the sockets 30 of the mounting base 20.

The first support member 32 is connected to the mounting base 20 by flexing the ends of the first support member 32 inwardly towards each other and inserting the balls 34 into the sockets 30 of the mounting base 20. Once the first support member 32 is released into the sockets 30, the first support member 32 is retained in the connection portions 24 by the resilient action of the ends of the first support member 32 acting against the connection portions 24. As configured and disposed on a table, the first support member 32 is flexed outwardly substantially parallel to the plane of the table and provides a secure and stable foundation upon which a second support member 40 is disposed.

Alternatively, the first support member and the base may be connected in any suitable manner including being integrally formed as a single unit so as to provided a U-channel for mounting to a table and a peripheral mounting surface for supporting a second support member.

As best shown in FIG. 1, the second support member 40 is pivotally disposed on the first support member 32. The second support member 40 has an upper portion 42 configured to be positioned above the plane of the table and a lower portion 44 configured to be positioned below the plane of the table when the net mounting assembly 10 is positioned on a table. Like the first support member 32, the second support member 40 is arcuate in shape and is preferably constructed from plastic. As configured and disposed on a table, the second support member 40 is substantially perpendicular to the first support member 32 and the table.

Figure 4:
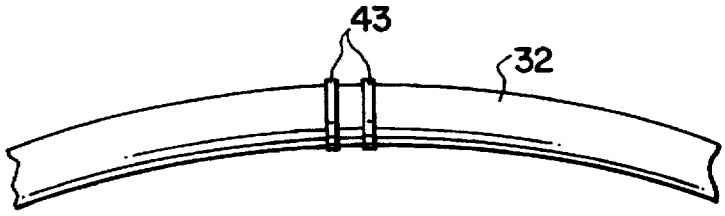
FIG. 4 is an exploded view of a central portion of a supporting member in accordance with the first embodiment of the present invention.

The second support member 40 includes a clip portion 41 integrally formed into the second support member 40 between the upper portion 42 and the lower portion 44. The clip portion 41 is configured to snap onto the first support member 32 such that the second support member 40 is substantially perpendicular to the first support member 32 and such that the second support member 40 can pivot relative to the first support member 32. The clip portion 41 should preferably be dimensioned to reduce the slack between the clip portion 41 and the first support member 32 so that the second support member 40 is confined to pivot in a plane substantially perpendicular to the first support member 32, i.e., a substantially vertical plane. As shown in FIG. 4, the first support member 32 preferably includes a pair of spaced and raised guides 43 that also assist to confine the second support member 40 to rotation in the plane perpendicular to the first support member 32. The guides 43 also prevent the second support member 40 from sliding laterally along the first support member 32.

The upper portion of the second support member is constructed and arranged to be connectable to a net. In accordance with one embodiment, as shown in FIG. 1, the end of the upper portion 42 defines a hole 46. An attachment member 48 is secured at one end to the hole 46 and at the other end to a net 50 thereby attaching the net 50 to the net mounting assembly 10. One skilled in the art will readily recognize that the attachment member 48 can be any member suitable for connecting a table tennis net including string, springs, cables, etc. As an alternative to the upper portion shown in FIG. 1, a configuration as shown and described hereinbelow, with reference to FIG. 5, could be provided.

The lower portion 44 of the second support member 40 is constructed and arranged to be connectable to a biasing member 52. More particularly, the end of the lower portion 44 defines a hole 54 into which the biasing member 52 can be connected. The biasing member 52 can be any suitable device that can bias the lower portion 44 including springs, shock cords, etc. When the net mounting assembly 10 is disposed on a table and the upper portion 42 and lower portion 44 of the second support member 40 are connected to the net 50 and biasing member 52, respectively, the lower portion 44 of the second support member 40 pivots inwardly towards the table in response to the biasing force of the biasing member 52. In response, the upper portion 42 of the second support member 40 pivots outwardly away from the table thereby tensioning the net 50 and keeping the net 50 substantially perpendicular to the table.

As one skilled in the art will, of course, recognize, two net mounting assemblies of the type illustrated in FIGS. 1 and 2 will be required to mount a table tennis net to a table. In that regard, a pair of net mounting assemblies 10 are prepared by connecting a first support member 32 into each of a pair of mounting bases 20, as described above. Thereafter, a second support member 40 is clipped onto each of the pair of first support members 32. The mounting bases 20 of the net mounting assemblies are then slipped over opposite edges of a table so that the mounting bases 20 are equally spaced from both ends of the table. Each side of a net is connected to the upper portions 42 of each second supporting member 40 so that the net extends across the center of the table, dividing the table into two equal halves. Finally, each lower portion 44 of the pair of second supporting members 40 is connected to a biasing member 52. Preferably, each end of a single shock cord is connected to the holes 54 of the lower portions 44 of the pair of second supporting members 40 so that the shock cord spans across the width and below the plane of the table. The force of the shock cord acting upon the second supporting members 40 below the plane of the table helps to pull both mounting bases 20 into the table and secure the mounting bases 20 to the table, as well as tensioning the net and keeping the net substantially perpendicular to the table.

Figure 5:
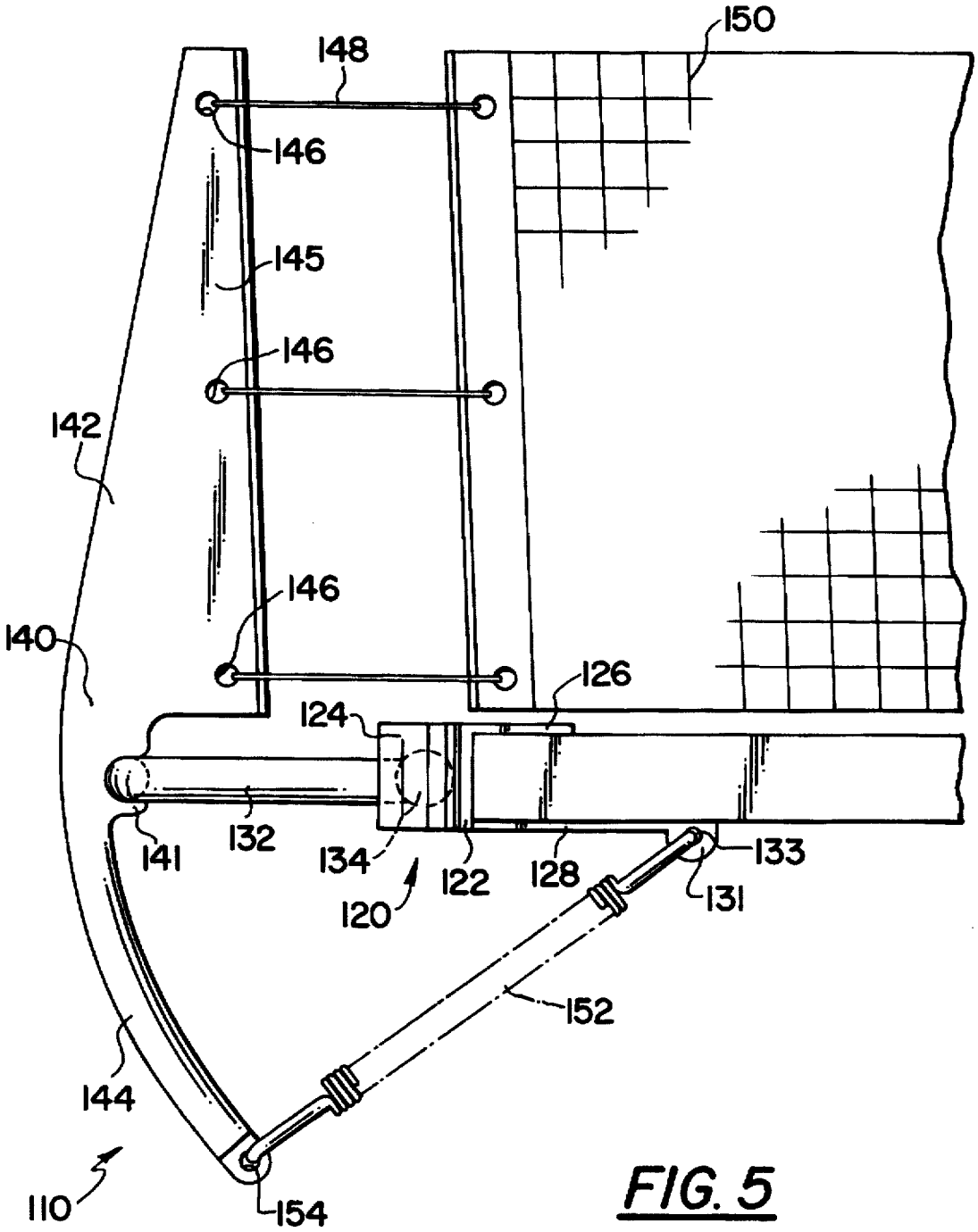
FIG. 5 is an elevational view of another embodiment of the net mount assembly in accordance with the present invention showing a connection of the net mount assembly to a table tennis net.

FIG. 5 shows a second embodiment in accordance with the principles of the present invention. Specifically, the net mounting assembly 110 of the present invention includes a mounting base 120. As with the first embodiment, the mounting base 120 provides the foundation upon which the remaining components of the present invention are disposed and is configured to be slipped over an edge of a playing surface, table or similar flat platform and to be stably maintained on the table without requiring a clamp. The mounting base 120 of the second embodiment is configured similarly to the mounting base of the first embodiment and includes a central portion 122 having a U-shape, transverse cross-section, connection portions 124 laterally spaced on each side of the central portion 122, and a first support member 132.

The central portion 122 includes an upper flange 126 that preferably extends the entire length of the mounting base 120. As discussed above, however, the upper flange 126 need only be long enough to allow the mounting base 120 to be stably and securely mounted to a table, and the upper flange 126 should also have sufficient width so that the mounting base 120 remains on the edge of a table when placed thereon.

The central portion 122 also includes a lower flange 128 spaced from the upper flange 126 thereby defining a channel therebetween. The lower flange 128 should be sufficiently spaced from the upper flange 126 so that the central portion 122 can be slipped over an edge of a table. The lower flange 128 also includes a tab 131 disposed centrally at the end of the flange 128. The tab 131 is configured to be connectable to a biasing member 152. Specifically, the tab 131 defines a hole 133 to which the biasing member 152 can be attached, as discussed below.

The connection portions 124 including sockets 130 are configured in the same manner as the connection portions 24 and sockets 30 of the first embodiment. Similarly, the first support member 132 including balls 134 are configured and attached to the connection portions 124 in the same manner as the first support member 32 and balls 34 are attached to the connection portions 24.

The net mounting assembly 110 includes a second support member 140 pivotally disposed on the first support member 132. The second support member 140 has an upper portion 142 configured to be positioned above the plane of the table and a lower portion 144 configured to be positioned below the plane of the table when the net mounting assembly 110 is positioned on a table. Like the second support member 40 of the first embodiment, the second support member 140 is substantially perpendicular to the first support member 132 when the net mounting assembly 110 is assembled for use on a table.

The upper portion 142 of the second support member 140 includes a vertical plate or flange 145. The flange 145 is constructed and arranged to be connectable to a net. In the illustrated embodiment, the flange 145 defines three, equally spaced holes 146 adjacent to the edge of the flange 145. Attachment members 148 extending from the net 150 can be secured to the holes 146 to attach the net 150 to the net mounting assembly 110. The spaced attachment of the attachment members 148 to the flange 145 helps to prevent rotation of the net that might otherwise occur about a single attachment point.

The second support member 140 also includes a clip portion 141 for pivotally connecting the second support member 140 onto the first support member 132. The clip portion is configured in the same manner as the clip portion 41 of the first embodiment.

The second support member 140 includes a lower portion 144 and is constructed and arranged to be connectable to the biasing member 152. More particularly, the end of the lower portion 144 defines a hole 154 into which the biasing member 152 can be connected. Each end of a single biasing member 152 can be connected to the holes 154 of the lower portions 144 of a pair of net mounting assemblies 110 so that the biasing member 152 spans across the width and below the plane of the table. Alternatively, as shown in FIG. 5, a pair of biasing members may be used. In this configuration, an end of the biasing member is connected to the hole 154, and the other end of the biasing member is connected to the hole 133 of the flange 128 of the base 120.

It will be seen by those skilled in the art that the objects of the present invention have been fully and effectively accomplished. It will also be realized, however, that the foregoing preferred embodiment has been shown and described for the purpose of illustrating the principles of the present invention and are subject to modification without departure from these principles. It will be appreciated that the structural and functional principles of the present invention apply equally to other embodiments. Therefore, the present invention includes all modifications encompassed within the spirit and scope of the following claims.

What is claimed is:

1. A net mounting apparatus for mounting a net onto a playing surface having longitudinal side edges of determined thickness, comprising:

a pair of net mounting assemblies, each of said net mounting assemblies comprising:

a mounting base constructed and arranged to be mounted to the longitudinal side edge of the playing surface, a first support member projecting from said mounting base; and a second support member having an upper portion and a lower portion, said second support member being pivotally coupled to said first support member such that when said net mounting assembly is disposed on the playing surface, said upper portion of said second support member is disposed above a plane of the playing surface and said lower portion of said second support member is disposed below the plane of the playing surface, wherein each upper portion of said pair of net mounting assemblies is adapted to be connected to an end of the net and each lower portion of said pair of net mounting assemblies is adapted to be operatively coupled to a biasing member such that when each net mounting assembly is mounted to a respective longitudinal side edge of the playing surface, and each lower portion is operatively coupled to a biasing member, and each upper portion is connected to the net, the lower portions pivot towards each other and the upper portions pivot away from each other thereby tensioning the net and maintaining the net substantially perpendicular to the table.

2. A net mounting apparatus according to claim 1, wherein each first support member of said pair of net mounting assemblies is substantially parallel to the plane of the playing surface when said net mounting assemblies are mounted to the playing surface and wherein each second mounting member of said pair of net mounting assemblies is substantially perpendicular to said first support members.

3. A net mounting apparatus according to claim 1, wherein each mounting base of said pair of net mounting assemblies includes a central portion having a U-shaped, transverse cross-section and connection portions laterally spaced on each side of said central portion, said central portion being constructed and arranged to be slipped over the longitudinal side edge of the playing surface and to be stably mounted on the playing surface without being clamped thereto.

4. A net mounting apparatus according to claim 3, wherein each first support member of said pair of net mounting assemblies is resiliently flexible, each first support member being constructed and arranged to be connected at ends thereof to said connection portions of said mounting base such that each first support member is flexed in the plane of the playing surface and is retained in said connection portions by a resilient action of said ends of said first support member against said connection portions.

5. A net mounting apparatus according to claim 3, wherein said central portion includes a tab centrally disposed on a bottom surface of said central portion, said tab being adapted to be operatively coupled to the biasing member.

6. A net mounting apparatus according to claim 5, further comprising a pair of biasing members, one of said pair of biasing members being operatively coupled between said lower portion of said second support member and said tab of said central portion of said mounting base of one of said pair of net mounting assemblies, the other of said pair of biasing members being operatively coupled between said lower portion and said tab of said central portion of the other of said pair of net mounting assemblies.

7. A net mounting apparatus according to claim 1, wherein each second support member of said pair of net mounting assemblies includes a clip portion integrally formed into said second support member, said clip portion being constructed and arranged to secure said second support member to said first support member and to confine said second support member to pivot in a plane substantially perpendicular to said first support member.

8. A net mounting apparatus according to claim 1, wherein each said first support member and each said second support member is arcuate in shape.

9. A net mounting apparatus according to claim 1, further comprising a biasing member operatively coupled to each lower portion of said pair of net mounting assemblies.

10. A net mounting apparatus according to claim 1, wherein said upper portion of each second support member includes a vertically oriented flange adapted to be connected to the end of the net, said flange defining a plurality of holes to which attachment members of the net can be secured to connect the end of the net to said upper portion.

11. A net mounting assembly for mounting a net onto a playing surface having longitudinal side edges of determined thickness, comprising:

a mounting base constructed and arranged to be mounted to the longitudinal side edge of the playing surface, a first support member projecting from said mounting base; and a second support member pivotally coupled to said first support member having a portion adapted to be connected to an end of the net, said second support member being constructed and arranged to pivot in response to a force acting below a plane of the playing surface such that the net is tensioned and maintained substantially perpendicular to the playing surface.

12. A net mounting assembly according to claim 11, wherein said first support member is substantially parallel to a plane of the playing surface when said net mounting assembly is mounted to the longitudinal side edge of the playing surface and wherein said second mounting member is substantially perpendicular to said first support member.

13. A net mounting assembly according to claim 11, wherein said mounting base includes a central portion having a U-shaped, transverse cross-section and connection portions laterally spaced on each side of said central portion, said central portion being constructed and arranged to be slipped over the longitudinal side edge of the playing surface and to be stably mounted on the playing surface without being clamped thereto.

14. A net mounting assembly according to claim 13, wherein said first support member is resiliently flexible, said first support member being constructed and arranged to be connected at ends thereof to said connection portions of said mounting base such that said first support member is flexed in the plane of the playing surface and is retained in said connection portions by a resilient action of said ends of said first support member against said connection portions.

15. A net mounting assembly according to claim 11, wherein said second support member includes a clip portion integrally formed into said second support member, said clip portion being constructed and arranged to secure said second support member to said first support member and to confine said second support member to pivot in a plane substantially perpendicular to said first support member.

16. A net mounting assembly according to claim 11, wherein said first support member and said second support member are arcuate in shape.

17. A net mounting assembly according to claim 11, wherein said second support member includes a lower portion extending below a plane of the playing surface when said net mounting assembly is mounted on the longitudinal side edge of the playing surface.

18. A net mounting assembly according to claim 17, wherein the force is applied to said lower portion of said second support member.

19. A net mounting assembly according to claim 18, wherein the force is applied by a biasing member connected to said lower portion.

20. A net mounting apparatus according to claim 11, wherein said portion of said support member defines a plurality of holes to which attachment members of the net can be secured to connect the end of the net to said support member.

* * * * *